United States Patent [19]

Greenvourcel

[11] 4,406,616

[45] Sep. 27, 1983

[54] SET OF MODULAR ELEMENTS PARTICULARLY USEFUL FOR ASSEMBLING CANDELABRA

[76] Inventor: Jacob Greenvourcel, Yona Salk St. 6, Holon, Israel

[21] Appl. No.: 250,836

[22] Filed: Apr. 3, 1981

[51] Int. Cl.[3] ..... F23D 3/16

[52] U.S. Cl. ..... 431/295; D26/13

[58] Field of Search ..... 431/295, 297; D26/9, D26/13, 15

[56] References Cited

U.S. PATENT DOCUMENTS

| | | | |
|---|---|---|---|
| D. 125,571 | 3/1941 | Kessler | D26/14 |
| D. 228,200 | 8/1973 | Anderson | D26/15 |
| 1,975,522 | 10/1934 | Swobe | 431/295 |
| 3,932,113 | 1/1976 | Thrush | 431/297 |

*Primary Examiner*—Edward G. Favors
*Attorney, Agent, or Firm*—Benjamin J. Barish

[57] ABSTRACT

A set of modular elements adapted to be assembled together according to various configurations to form various decorative candelabra. The set includes four modular elements each having two parallel arms serving as candlesticks and joined together at their lower ends by L-shaped or curved-shaped bridging sections adapted to support the candlestick arms in spaced, parallel, vertical positions. The bridging sections are all complementarily-bent, and have different lengths which are whole-integer multiples of the outer transverse dimension of the two candlestick arms, to permit a plurality of the modular elements to be nested together at their bridging sections according to various ornamental configurations.

10 Claims, 15 Drawing Figures

SET OF MODULAR ELEMENTS PARTICULARLY USEFUL FOR ASSEMBLING CANDELABRA

BACKGROUND OF THE INVENTION

The present invention relates to a set of modular elements adapted to be assembled together according to various configurations. The invention is particularly useful for forming candelabra of various ornamental configurations, and is therefore described below with respect to this application.

BRIEF SUMMARY OF THE INVENTION

According to a broad aspect of the present invention, there is provided a set of modular elements adapted to be assembled together according to various configurations, characterized in that the set includes a plurality of modular elements each having two parallel arms joined together at one end by a bridging section bent out of the plane of the arms to enable the bridging section of the respective modular element to stably rest in a horizontal position on a horizontal surface and to support the two arms in spaced, parallel, vertical positions. The bridging sections are all complementarily bent, and have different lengths which are whole-integer multiples of the outer transverse dimension of the two arms, to permit a plurality of the modular elements to be nested together at their bridging sections according to various configurations.

The invention is particularly useful for forming candelabra of different ornamental appearances, wherein each of the arms of the modular elements is a candlestick, and includes a socket at its upper end for receiving a candle.

Further features of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1C:
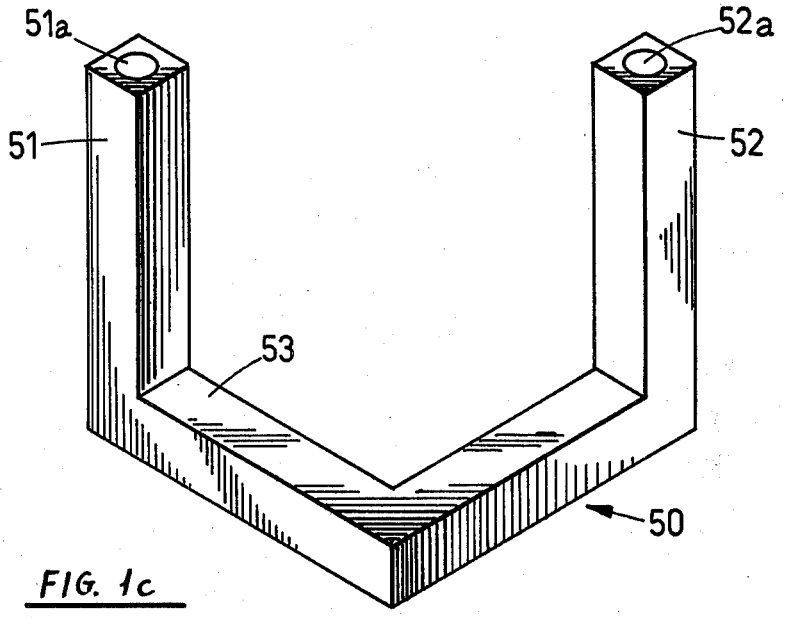
FIGS. 1*a*, 1*b* and 1*c* are three-dimensional views of three modular elements of one set constructed in accordance with the invention, this set being adapted to be assembled together to form candelabra of various ornamental appearances.
Figure 1B:
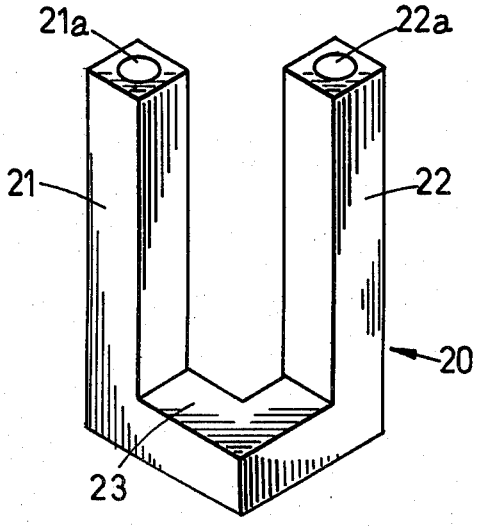
Figure 1A:
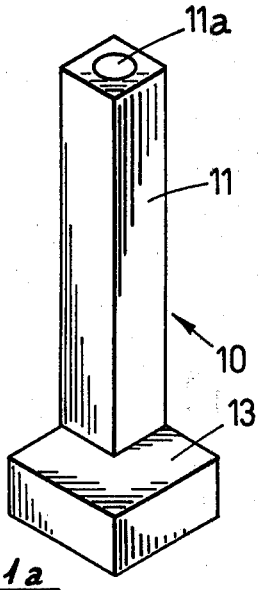
Figure 2:
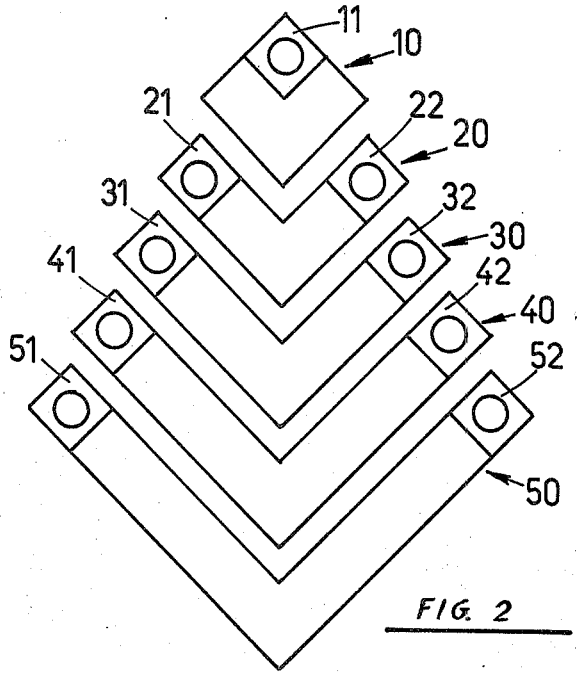
FIG. 2 is a top plan view of all five modular elements of the set represented by FIGS. 1*a*, 1*b* and 1*c*.

The set illustrated in FIG. 2 includes five modular elements, generally designated 10, 20, 30, 40 and 50, respectively. Modular element 10 is illustrated in FIG. 1*a* and supports only one candlestick 11, whereas the other four modular elements each support two candlesticks, these being candlesticks 21 and 22 for modular element 20, candlesticks 31 and 32 for modular element 30, candlesticks 41 and 41 for modular element 40, and candlesticks 51 and 52 for modular element 50. The smallest two-candlestick modular element 20 is better illustrated in FIG. 1*b*, and the largest two-candlestick modular element 50 is better illustrated in FIG. 1*c*. The remaining two-candlestick modular elements 30 and 40 are of the same basic construction and configuration as shown in FIGS. 1*b* and 1*c* except that they have different dimensions as will be described more particularly below.

As indicated in FIG. 2, the basic modular dimension is designated "a". This is the width and breadth of each of the nine illustrated candlesticks defined by the five modular elements 10–50; thus, these candlesticks are shown in FIG. 2 as of square cross-section of width "a" and breadth "a".

The basic dimension "a" is also used with respect to the supporting structure of the modular elements for supporting their respective candlesticks to enable the modular elements to be nested together according to any one of a plurality of different configurations, as will be described more particularly below.

Thus, as shown in FIG. 1*a*, the single-candlestick element 10 includes, in addition to its candlestick 11, a base 13 enabling its candlestick to be supported in a vertical position on a horizontal surface. Base 13 is also of square configuration, but each of its dimensions is equal to "2a". Its candlestick 11 occupies one corner of base 13, so that the candlestick is spaced from the two opposite sides of the base also by the distance "a", as clearly indicated in FIG. 2.

Figure 3B:
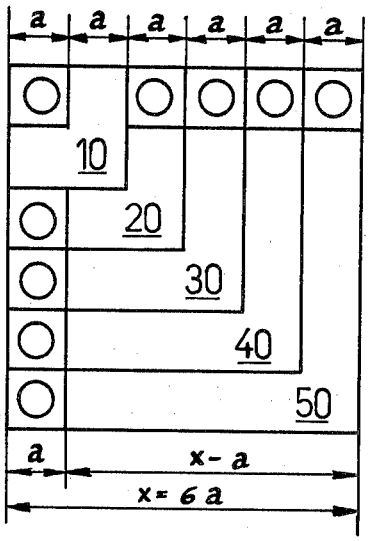
FIGS. 3*a* and 3*b* are three-dimensional and top plan views, respectively, illustrating one of the configurations in which the set of modular elements of FIG. 2 may be assembled.
Figure 3A:
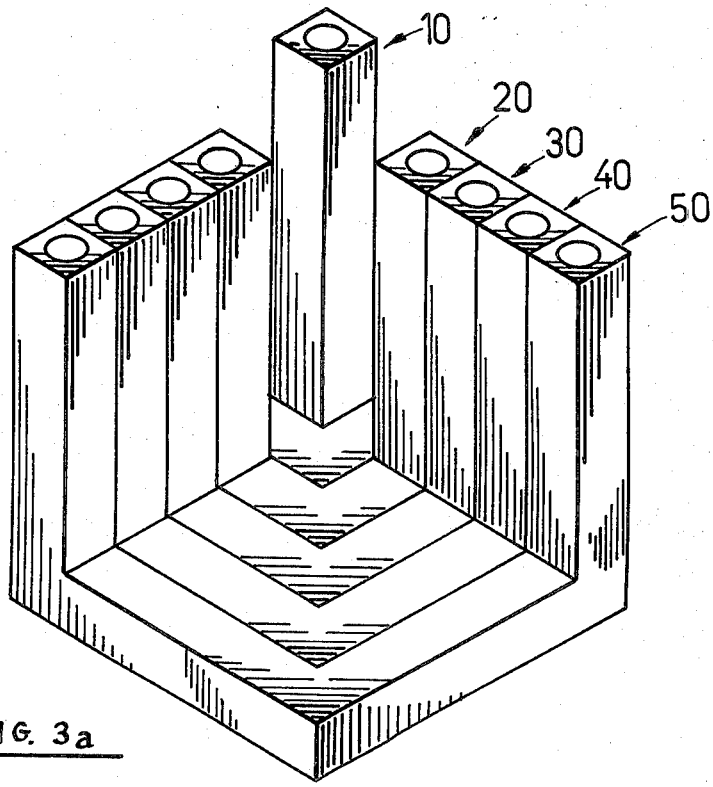
Figure 4A:
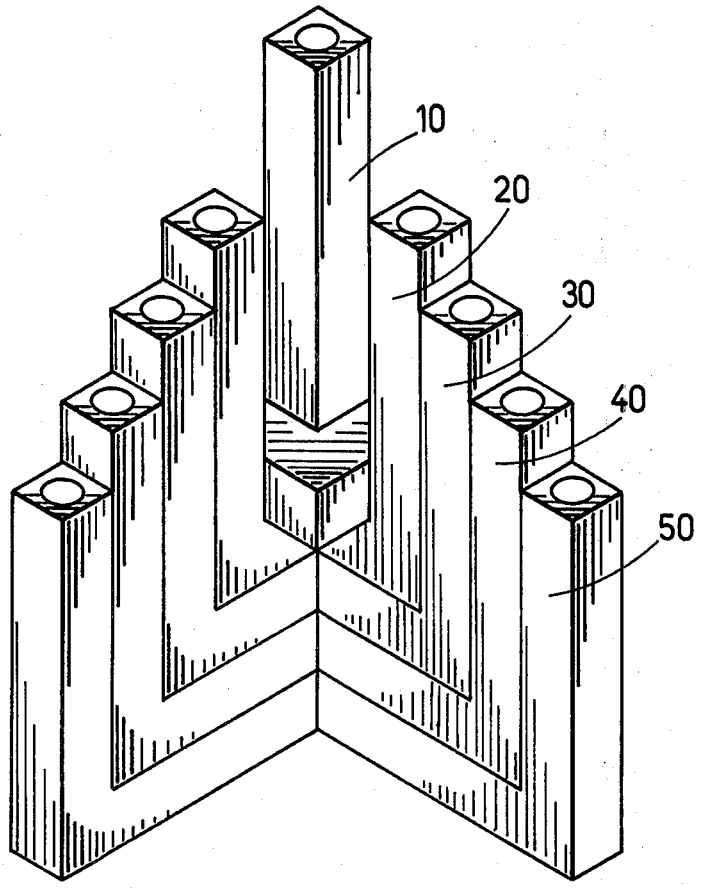
FIGS. 4*a* and 4*b* are three-dimensional and top plan views, respectively, illustrating another configuration in which the set of modular elements of FIG. 2 may be assembled.
Figure 4B:
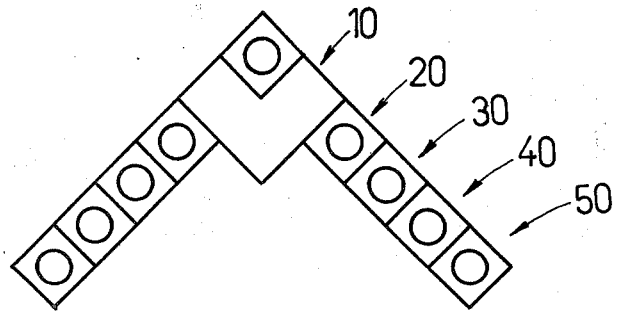

The height of base 13 of modular element 10 is also equal to "a". However, the height of its candlestick 11 is not critical, but should preferably exceed the height of the candlesticks in the two-candlestick elements 20, 30, 40, 50 so as to project above them when all the modular elements are arrayed according to the basic configuration illustrated in FIGS. 3*a* and 3*b*.

The two-candlestick modular elements 20, 30, 40 and 50, are all of the same basic construction except that their bridging sections 23, 33, 43 and 53, respectively, have heights all equal to the basic dimension "a" but lengths which are different whole-integer multiples of "a".

Thus, each of the two right-angle legs constituting the bridging section 23 of modular element 20 has a length along its inner edge equal to "a", and a length along its outer edge equal to "2a". An imaginary center square, indicated by broken lines 24 in FIG. 1, is thus found at the juncture of the two legs of bridging section 23, which imaginary square has a length of "a" along each side.

In a similar manner, the inner edge of each candlestick 31, 32 in modular element 30 is spaced a distance equal to "2a" from the corresponding imaginary square at the juncture of the two right-angle arms of its bridging section 33; the inner edge of each candlestick 41, 42 in modular element 40 is spaced a distance equal to "3a" from the corresponding imaginary square at the juncture of the two right-angle arms of its bridging section 43; and the inner edge of each candlestick 51, 52 in modular element 50 is spaced a distance equal to "4a" from the corresponding imaginary square at the junction of the two right-angle arms in its bridging section 53.

The upper end of each of the nine candlesticks defined by the five modular elements 10, 20, 30, 40 and 50, is formed with a socket, as shown at 14 for element 10, for receiving a candle.

It will be seen that the modular elements 10–50, when constructed as described above, may be disposed according to various configurations.

FIGS. *3a, 3b* illustrate a basic disposition wherein the four two-candlestick elements 20–50 are nested together with their bridging sections in horizontal alignment, the one-candlestick element 10 occupying the corner position and nested against the smallest two-candlestick element 20. It will thus be seen that all the candlesticks are aligned in two rows at right angles to each other, with the candlestick 11 of the single-candlestick element 10 at the juncture of, spaced from, and projecting above, the other candlesticks. Such a disposition of the modular elements is particularly useful for forming a "Chanukah Menora", namely, a nine-branched candelabrum used in the holiday festival of Chanukah, wherein the candle received in the corner candlestick 11, spaced from the others, serves as the "Shamash" for lighting the candles of the other eight candlesticks.

FIGS. *4a* and *4b* illustrate another disposition of the same five modular elements 20–50. In this disposition, the modular elements are nested in a vertical position. That is, the bridging sections of the modular elements are vertically stacked one on top of the other with the largest modular element 50 occupying the lowest position and the smallest modular element 10 occupying the highest position. It will be seen that in this arrangement the candles are disposed in two right-angle rows, but in ascending order, with candlestick 11 occupying the highest position and located at the juncture of the two rows. Such an arrangement is also suitable for a Chanukah candelabrum, with candlestick 11 serving as the "Shamash", being spaced both laterally and elevationally from the other candlesticks to set it apart.

Figure 5:
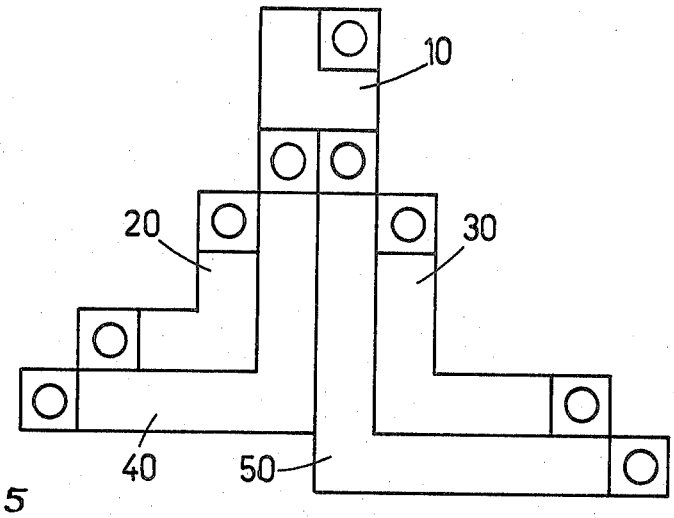
FIGS. 5 and 6 are top plan views illustrating two further configurations in which the set of modular elements of FIG. 2 may be assembled.

FIG. 5 illustrates a still further disposition of the modular elements 20–50, wherein it will be seen that element 50 faces one direction and receives element 30 on one side, while element 40 faces the opposite direction and receives element 20 on the opposite side, the single-candlestick element 10 being disposed to bridge the ends of both elements 40 and 50.

Figure 6:
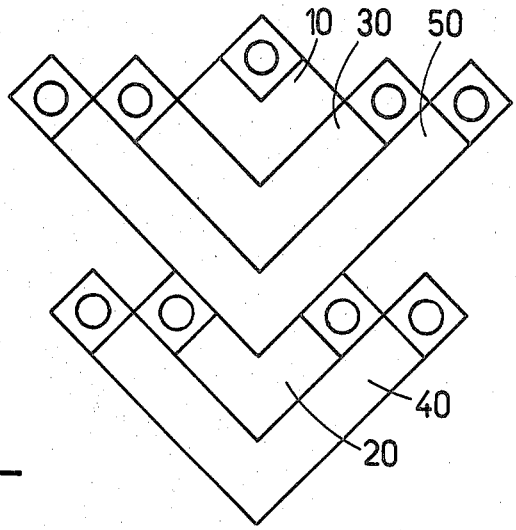

FIG. 6 illustrates a still further variation, wherein the modular elements 20–50 are horizontally nested in the following sequence starting from the "Shamash": 10, 30, 50, 20, and 40.

FIGS. *7a* and *7b* illustrate a modification in the construction of the modular elements, wherein the elements, therein designated 110–150, instead of being of square cross-section, are of circular cross-section in both their candlestick and bridging sections. Their construction, dimensions, and possible dispositions, are otherwise the same as described above with respect to FIGS. 1–6.

FIGS. *8a* and *8b* illustrate a still further variation, wherein the modular elements, therein designated 210–250, include curved bridging sections 213, 223, 233, 243 and 253, respectively, instead of the right-angle bridging sections in the previously-described arrangements. Thus, the bridging sections of the modular elements may be nested or stacked with respect to each other not only in the illustrated horizontal disposition as described above with respect to FIGS. *3a* and *3b*, but also in many of the other described dispositions. The base 213 of the single-candle modular element is provided with a complementarily curved surface for nesting against the bridging section 223 of the smallest modular element 220.

Figure 9:
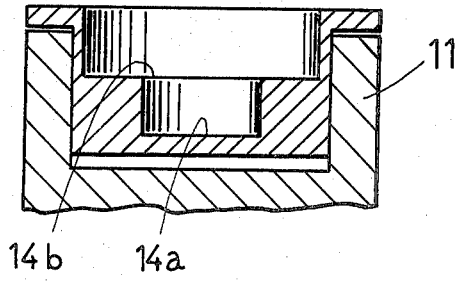
FIG. 9 is a sectional view along lines IX—IX of FIG. 1*a*, illustrating the construction of the candle-receiving socket in each of the candlesticks of the candelabra assembled by the use of the modular elements of FIG. 2.
Figure 7A:
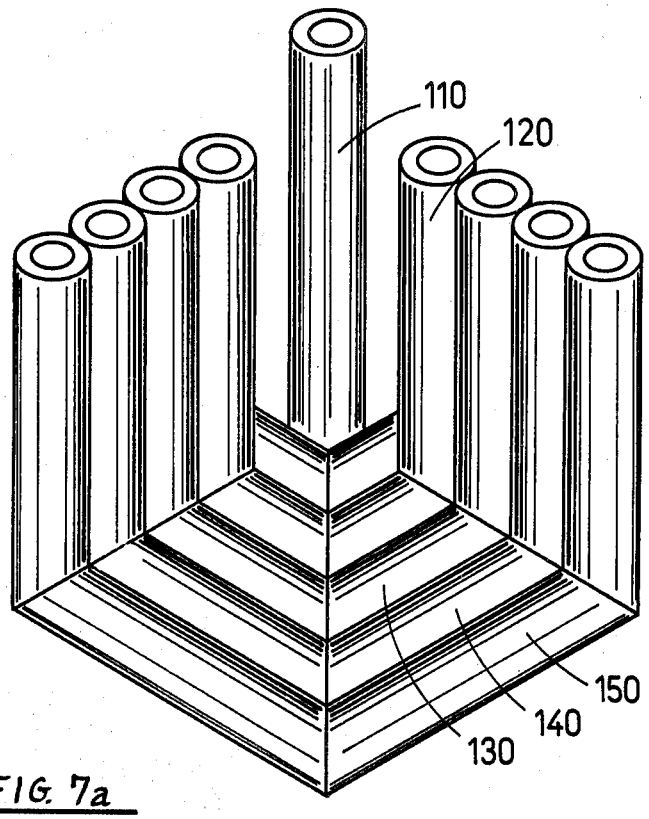
FIGS. 7*a* and 7*b* are three-dimensional and top plan views, respectively, illustrating a modified construction which may be used for the set of modular elements of FIG. 2.
Figure 7B:
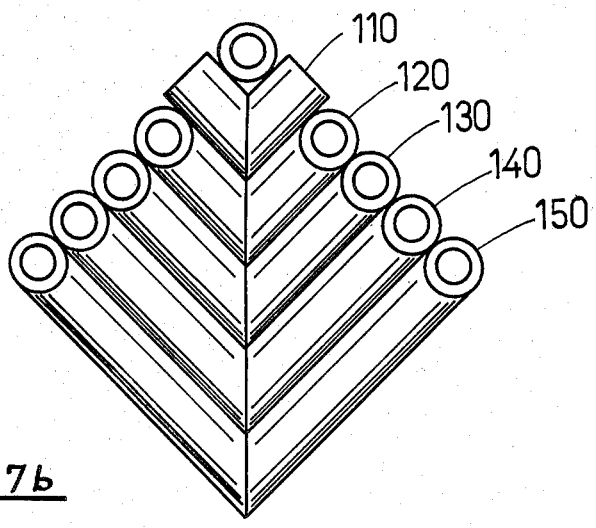
Figure 8A:
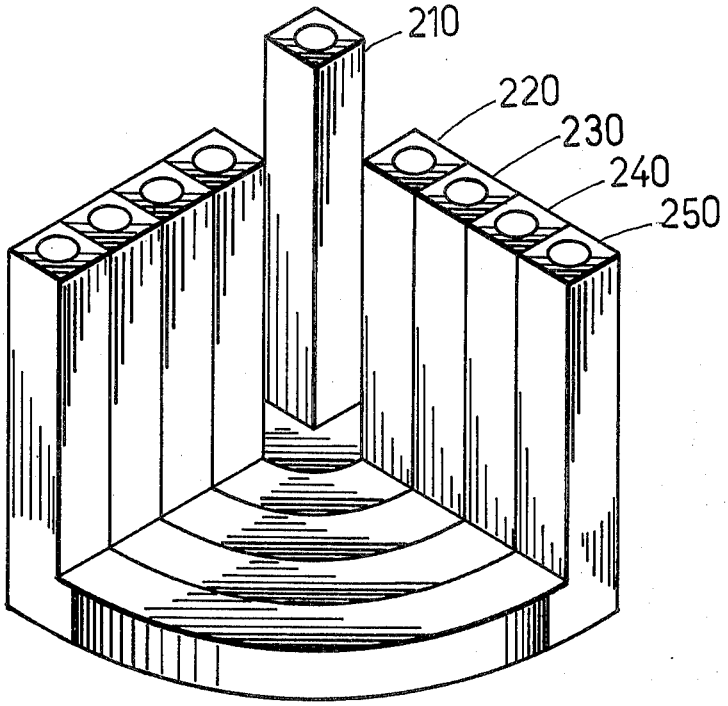
FIGS. 8*a* and 8*b* are three-dimensional and top plan views, respectively, illustrating a further modified construction which may be used for the set of modular elements of FIG. 2.
Figure 8B:
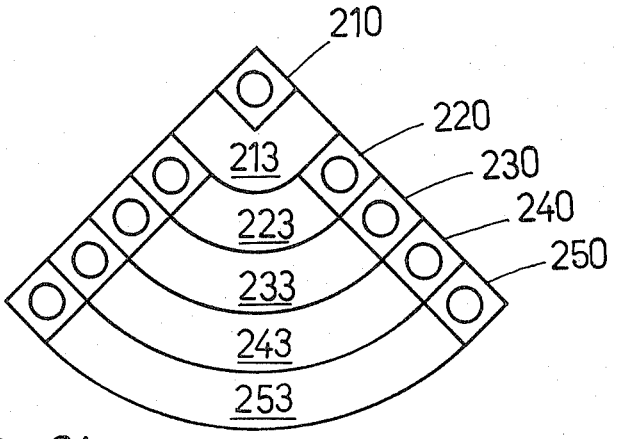

The candle receiving sockets, e.g. 14 of candlestick 11 illustrated in FIG. *2a*, are of the same construction for all the candlesticks. Preferably, such a socket is as illustrated in FIG. 9, wherein it includes a central recess 14*a*, and an outer recess 14*b* circumscribing recess 14*a* and of smaller depth but of larger diameter than recess 14*a*. Thus, recess 14*a* is adapted to receive a small-diameter candle such as may be used in a Chanukah Menora, and the larger recess 14*b* may be used for receiving a larger-diameter candle, such as a Sabbatical candle. Thus, for Sabbatical purposes, one or more of the modular elements, e.g. one or more of the candlestick elements 20–50, may be used.

While the invention has been described with respect to several preferred embodiments for use in assembling various configurations of candelabra, it will be appreciated that many other variations, modifications and applications of the invention may be made.

What is claimed is:

1. A set of modular elements adapted to be assembled together according to various configurations, characterized in that said set includes a plurality of modular elements each having two parallel arms joined together at one end by a bridging section bent out of the plane of the arms to enable the bridging section of the respective modular element to stably rest in a horizontal position on a horizontal surface and to support the two arms in spaced, parallel, vertical positions; said bridging sections all being complementarily bent, and having different lengths which are whole-integer multiples of the outer transverse dimension of the two arms, to permit a plurality of said modular elements to be horizontally nested together at their bridging sections according to various configurations.

2. A set of modular elements according to claim 1, wherein each of said bridging sections is bent to define two right-angle legs of equal length in the respective modular element, thereby supporting its two respective arms along laterally-offset, parallel, spaced axes.

3. A set of modular elements according to claim 1, wherein each of said bridging sections is bent to the same curvature, to support its two respective arms along laterally-offset, parallel, spaced axes.

4. A set of modular elements according to claim 1, wherein said set further includes an additional modular element having a single arm and a base adapted to stably rest on a horizontal surface to support its single arm in a vertical position parallel to the arms of the other modular elements, said base being of a configuration, and having dimensions, to permit same to be nested with the shortest-length two-arm modular element.

5. A set of modular elements according to claim 1, wherein each of said arms of the modular elements is a candlestick, and includes a socket at its upper end for receiving a candle therein.

6. A set of modular elements according to claim 5, wherein said set includes at least four of said modular elements to permit assembling a candelabrum of at least eight candlesticks.

7. The set according to claim 6, further including an additional modular element having a single arm defining a ninth candlestick, and a base for supporting said single arm in a vertical position parallel to the candlesticks of the other modular elements, said base being of a configuration, and having dimensions, to permit same to be nested with the shortest-length two-candlestick modular element.

8. The set according to claim 5, wherein said socket at the upper end of each arm includes a central recess of small diameter circumscribed by an outer recess of smaller depth but of larger diameter for selectively receiving either a small-diameter or a larger-diameter candle.

9. The set according to claim 1, wherein the cross-section of the arms and bridging sections of each modular element is of square configuration.

10. The set according to claim 1, wherein the cross-section of the arms and bridging sections of each modular element is of circular configuration.

* * * * *